United States Patent [19]

McKee

[11] 4,127,315

[45] Nov. 28, 1978

[54] CABLE CLAMP AND HOOD CONSTRUCTIONS FOR USE WITH RIBBON CONNECTORS

[75] Inventor: William H. McKee, West Covina, Calif.

[73] Assignee: TRW Inc., Elk Grove Village, Ill.

[21] Appl. No.: 797,587

[22] Filed: May 16, 1977

[51] Int. Cl.[2] ..... H01R 13/58

[52] U.S. Cl. ..... 339/103 B; 24/257; 174/138 F; 339/107; 339/223 R; 339/272 UC

[58] Field of Search ..... 339/103 R, 103 M, 103 B, 339/107, 223, 272 UC; 24/115 A, 129 B, 257 R; 174/138 F

[56] References Cited

U.S. PATENT DOCUMENTS

| | | | |
|---|---|---|---|
| 3,286,963 | 11/1966 | Bergman | 24/257 R |
| 3,739,435 | 6/1973 | Baker | 24/257 R |
| 3,951,501 | 4/1976 | Bauerle et al. | 339/107 X |
| 4,035,051 | 7/1977 | Guy | 339/107 X |

*Primary Examiner*—Roy Lake
*Assistant Examiner*—DeWalden W. Jones
*Attorney, Agent, or Firm*—Neuman, Williams, Anderson & Olson

[57] ABSTRACT

A cable clamp for use with various ribbon connectors is readily mounted on a connector end for providing a strain relief avoiding inadvertent disengagement of wires terminated in contacts of the connector. A protective hood construction is designed to cover the connector contacts and support the cable clamp. After the clamp is fixed in place and the wire terminations visually inspected, the hood is readily snapped in place. The provided clamp is particularly well-suited for automated assembly operations, requiring no discrete securing elements but merely a squeezing or clamping engagement with a cable to impart desired strain relief. The hood similarly requires no separate securing means for interlocking assembly with the connector and clamp.

47 Claims, 24 Drawing Figures

FIG. 3
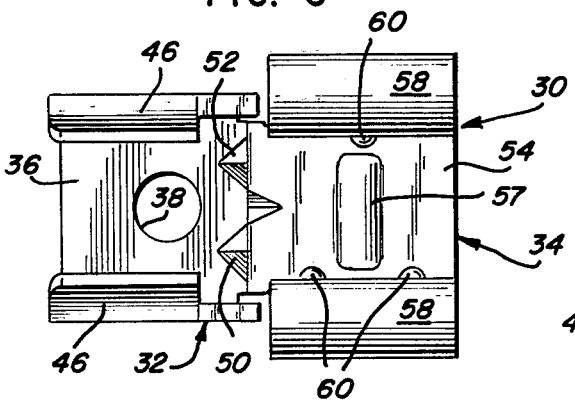
FIG. 4
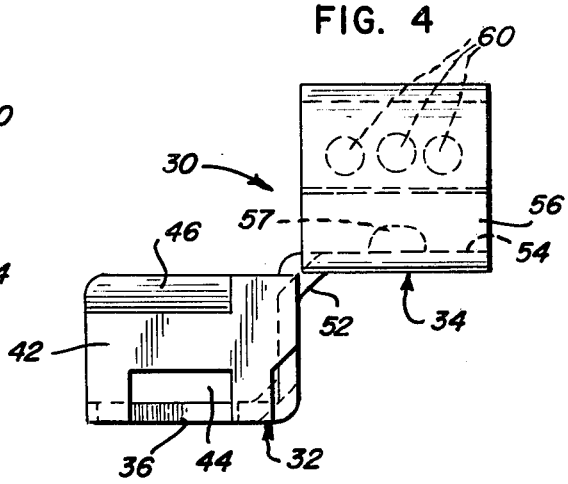
FIG. 6
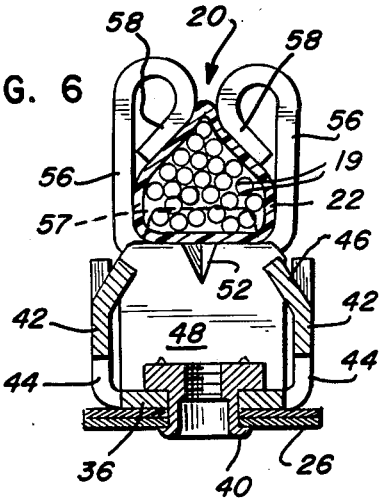
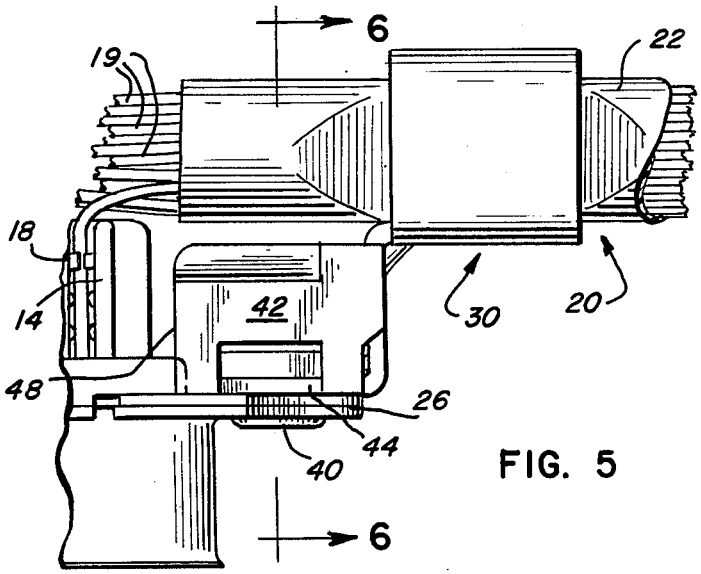
FIG. 5

FIG. 8
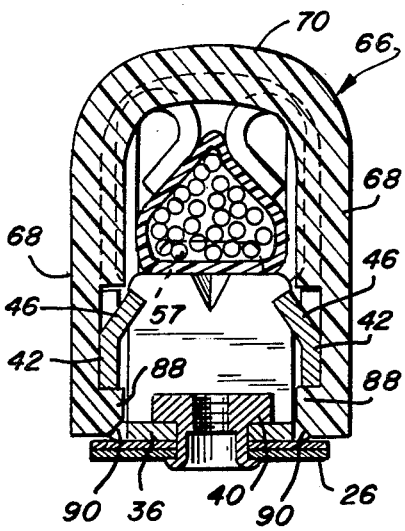
FIG. 7
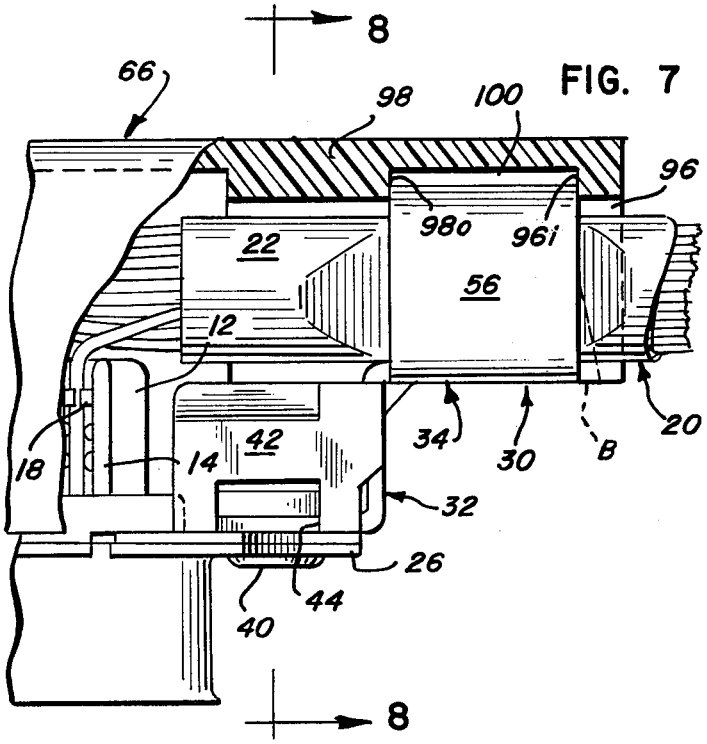
FIG. 9
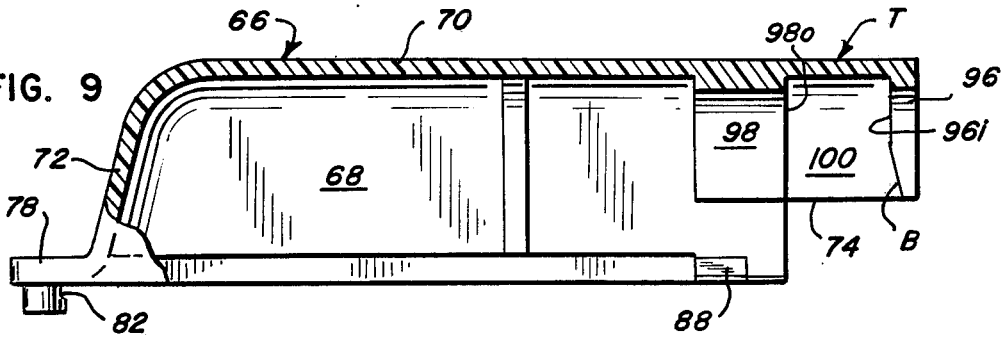
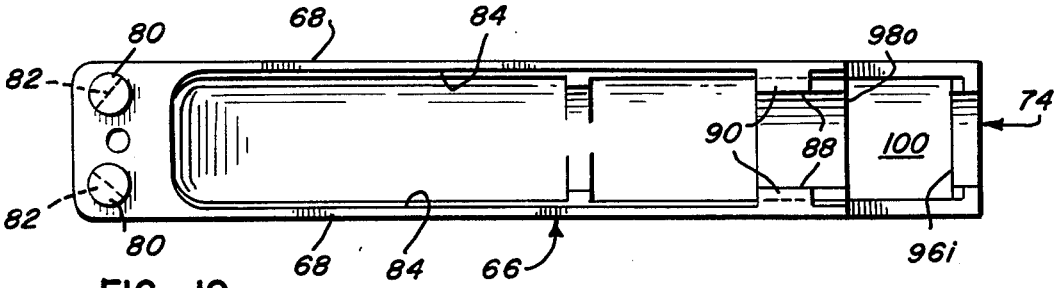
FIG. 10
FIG. 12
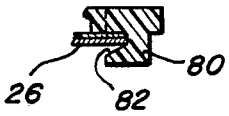
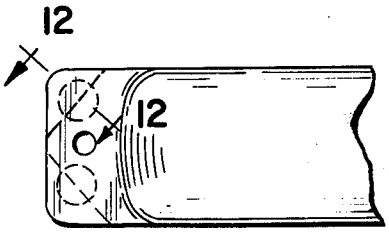
FIG. 11

FIG. 13
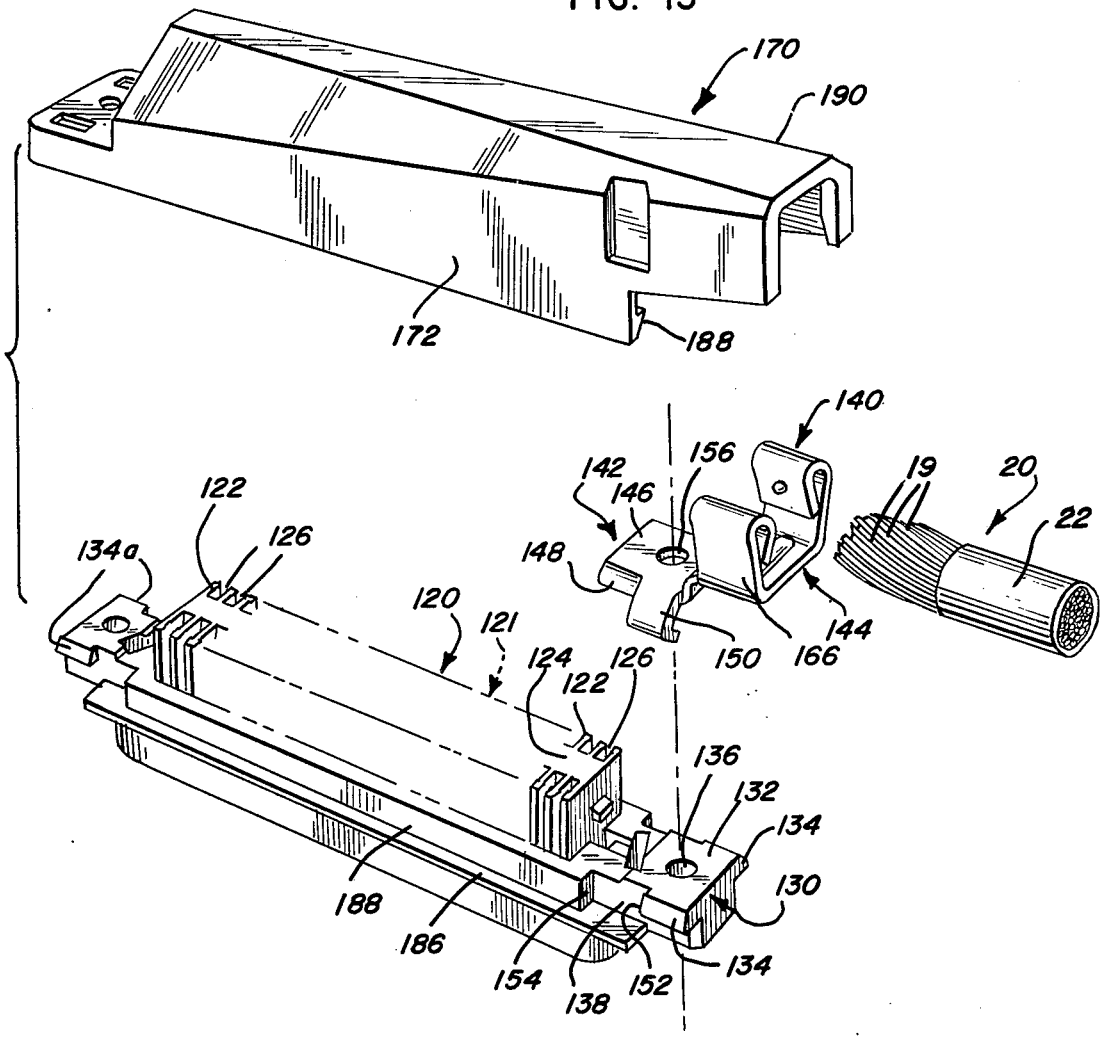
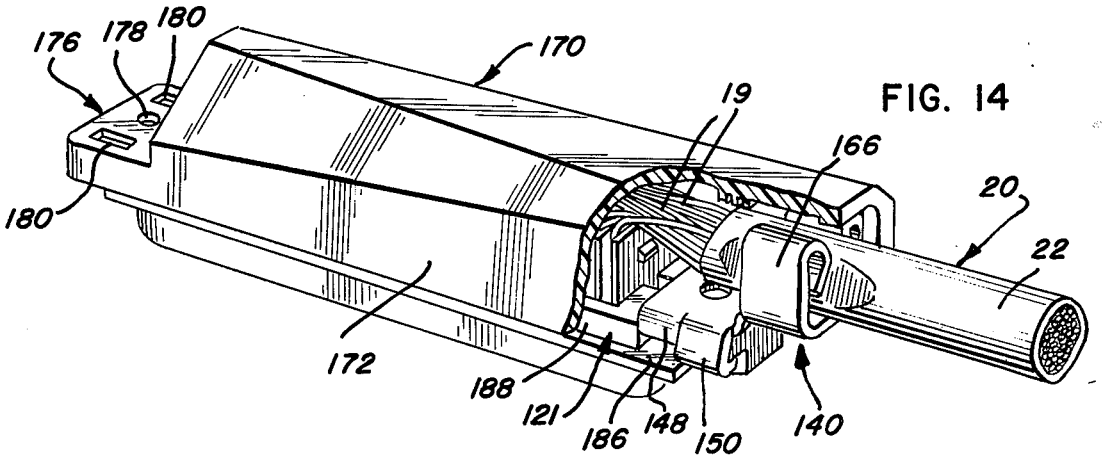
FIG. 14

FIG. 20
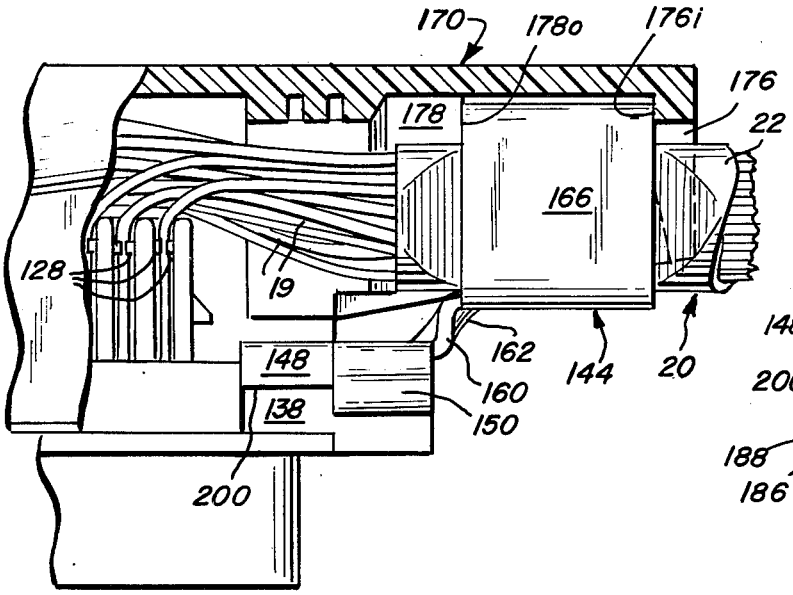
FIG. 21
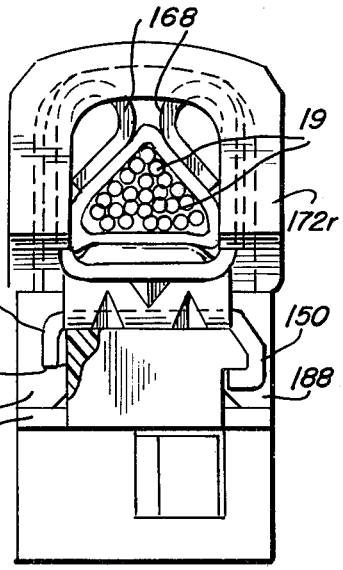
FIG. 22
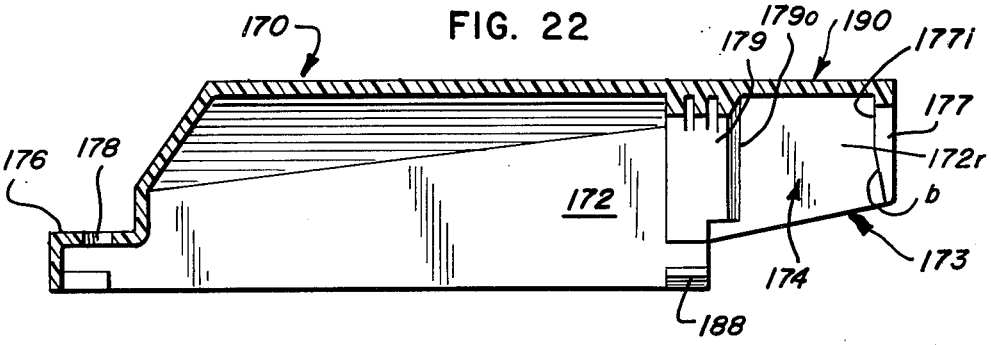
FIG. 23
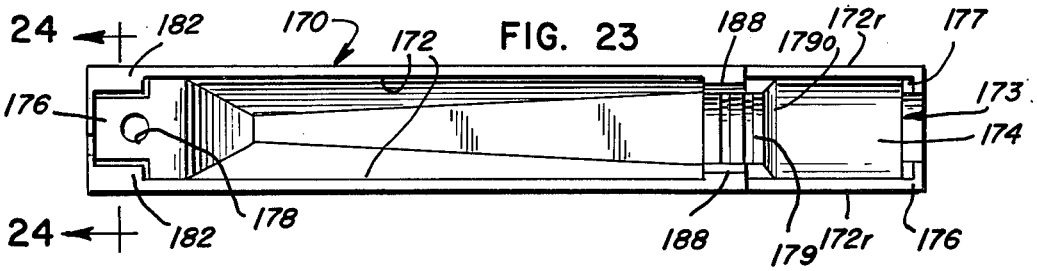
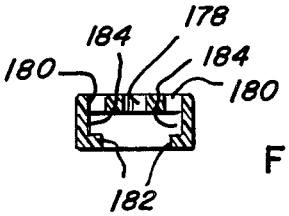
FIG. 24

CABLE CLAMP AND HOOD CONSTRUCTIONS FOR USE WITH RIBBON CONNECTORS

This application relates to cable clamps and hoods for electrical connectors and more specifically to improvements in clamps and cover constructions such as are disclosed and claimed in the application of McKee and Witte Ser. No. 797,588 filed concurrently herewith and entitled Cable Clamp Construction.

This invention relates to novel cable clamp and hood constructions, and more particularly pertains to constructions adapted to be readily assembled with multi-wire connectors in a manner which is unique in the connector art.

The use of clamp and hood constructions with electrical connectors is well-known in the art. The connector and hood constructions hereinafter described in detail are particularly adapted for use with ribbon-type connector and termination systems known as so-called miniature ribbon termination systems or high density systems in which a plurality of wires are terminated in closely adjacent relationship. The individual wires to be terminated may be connected to the individual connector contacts by various means such as solder employing or solderless techniques.

Following termination of the wires in a connector, a hood may be secured to such a connector in a manner known in the art to protectively envelop the wires attached to the contacts. Quite often a cable clamp is an integral part of the hood which clampingly engages the cable entering the hood so as to relieve the strain on the wire-contact terminations.

Steinbach U.S. application Ser. No. 672,643, filed Apr. 1, 1976, discloses a connector hood construction having a cable clamp integrally formed therewith. The hood readily snaps into interlocking engagement with ribbon connectors so as to cover the terminated wire portions for protective purposes. Other connector cover constructions having strain relief devices integrally formed therewith are disclosed in patents such as Ayer U.S. Pat. No. 3,876,276.

In all of the above-mentioned prior art devices the connectors having the wires terminated therein are first covered. The cables containing the wires terminated in the connector contacts are then clamped by the clamps integrally formed with the connector hoods or covers to eliminate strain being imparted to the contact terminations as when an axial force is imparted to the clamped cables. As a result, the terminated wires cannot be visually inspected at the time the strain relief clamp is secured to the cable for strain relief purposes.

The aforementioned McKee and Witte application pertains to improved clamps which may be attached to the connector independently of the hood and which therefore serve the cable strain relief function independently of the placement of the hood. Thus, the cable may be clamped prior to application of the hood, and either prior to or after the individual wires are terminated in the connector. Further, clamps in accordance with the basic invention of that application may be engaged with the cable simply by bending or deforming the clamp portion which is formed of a ductile metal. This invention pertains to improved and advantageous clamps employing the basic invention of the aforementioned McKee and Witte application, to improved hoods for simplified attachment to the connectors, and to unique cooperative combinations of hoods and such clamps by which the strain relief function of the clamp is greatly enhanced.

It is an object of this invention to provide improved cable clamp and hood constructions which enable the clamp to be secured to a ribbon connector for strain relief purposes and the wires terminated in the connector contacts, after which a protective hood may be assembled over the connector clamp assembly.

It is a further object of this invention to provide a simplified cable clamp construction for purposes of affording strain relief to wires emanating from a cable engaged by such clamp, such clamp construction being readily assembled to a connector member and readily engageable with a cable member to be clamped as by a simple pliers-type or automated bending action.

It is yet another object of this invention to provide an improved connector hood construction specifically designed for use with a connector-clamp assembly which is constructed so as to obviate the imparting of any bending moments to a clamp portion of the connector-clamp assembly in the normal course of hood use.

It is another object of this invention to provide a variety of cable clamps having varying mounting structures whereby the same may be utilized with a plurality of connector constructions.

It is a further object of this invention to provide a protective hood construction for utilization with a multi-terminal connector which is readily snapped into interlocking engagement with a connector-clamp assembly without the need for any extraneous securing means such as screws or the like.

The above and other objects of this invention will become more apparent from the following detailed disclosure when read in the light of the accompanying drawings and appended claims.

In one embodiment of a provided clamp construction, a clamp anchoring portion having a base integrally formed with opposed side walls and an end wall is secured by means of a rivet, screw or the like to one end of a ribbon-type connector. Extending from the clamp end wall at right angles thereto is a cable clamp portion comprising opposed clamping ears adapted to be inwardly flexed into clamping engagement with an interposed cable. The ears are maintained in spaced relation by means of a clamp base portion integrally formed with the end wall of the clamp anchoring portion.

The opposed side walls of the clamp anchoring portion define shoulders whereby they may receive detent portions of a hood member in interlocking engagement.

The hood member comprises an enclosure having opposed parallel walls and a closed end portion defining one longitudinal end thereof. The opposed end of such hood as well as the bottom thereof defined by the distal edges of the opposed parallel walls are open. Extending outwardly from the closed end of the hood is a planar tab portion having formed on the under surface thereof facing away from the hood parallel walls, spaced members adapted to slidably engage the end portion of a multi-contact connector.

The open end of the hood is configured to receive the end of the connector having the cable clamp mounted thereon. Inner peripheral surface portions of the hood end adjacent the open end have spaced ridges or collars formed thereon so as to receive the cable clamping portions therebetween. Bending moments which may be imparted to the juncture between the cable clamp anchor and clamp portions are thus dissipated by virtue of the confined condition of the clamping portion disposed snugly between the terminal hood collars as will hereinafter be disclosed in greater detail.

The provided assembly of connector clamp and hood enables wires to be terminated in a connector after which the cable from which the wires pass is clamped securely in place on one end of the connector, providing a strain relief preventing the breaking of wire terminations in the connector as a result of axial forces imparted to the cable. After the cable has been clamped in place and proper wire terminations in the connector contacts assured by visual inspection, an overlying hood may be readily set in place by means of a bayonet-type engagement between the slotted projections disposed at one hood end and a locking engagement effected between detents disposed on inner surface portions of the hood parallel walls adjacent the open end thereof and the shoulder portions of the clamp.

In a modified cable clamp construction adapted to be mounted on an all-plastic connector, the anchor portion of the cable clamp has opposed base edge portions which clampingly engage opposed end surfaces of the connector end portion on which the cable clamp is mounted.

For a more complete understanding of this invention reference will now be made to the drawings wherein:

FIG. 3 is a top plan view of the cable clamp of FIG. 1 illustrated on an enlarged scale;

FIG. 4 is a side elevational view of the cable clamp illustrated in FIG. 3;

FIG. 5 is a fragmentary side elevational view of the cable clamp of FIG. 1 in assembled relationship with the right end portion of the connector illustrated in FIG. 1;

FIG. 6 is a sectional view taken on line 6—6 of FIG. 5;

FIG. 7 is a view similar to FIG. 5 but also illustrating the hood of FIG. 1 in assembled relationship with the cable clamp and connector;

FIG. 8 is a sectional view taken on line 8—8 of FIG. 7;

FIG. 9 is a sectional view partly in elevation of the hood member of FIG. 1;

FIG. 10 is a bottom plan view of the hood of FIG. 9;

FIG. 11 is a fragmentary bottom plan view of the left end portion of the hood illustrated in FIG. 1;

FIG. 12 is sectional view taken on line 12—12 of FIG. 11;

FIG. 13 is a perspective view illustrating an all-plastic body ribbon-type connector, a cable clamp to be mounted thereon and a hood construction particularly adapted to engage the connector and clamp illustrated;

FIG. 14 is a perspective view partly broken away, illustrating the elements of FIG. 13 in a normal position of assembly;

FIG. 20 is a side elevational view, of the broken away portion of FIG. 14, illustrating the hood member of FIG. 13 in engagement with the clamp and connector illustrated in FIG. 13, in a normal position of assembly;

FIG. 21 is an end elevational view of the assembly of FIG. 20;

FIG. 22 is a longitudinal sectional view of the hood member illustrated in perspective in FIG. 13;

FIG. 23 is a bottom plan view of the hood member of FIG. 22; and

FIG. 24 is a sectional view taken on line 24—24 of FIG. 23.

Figure 1:
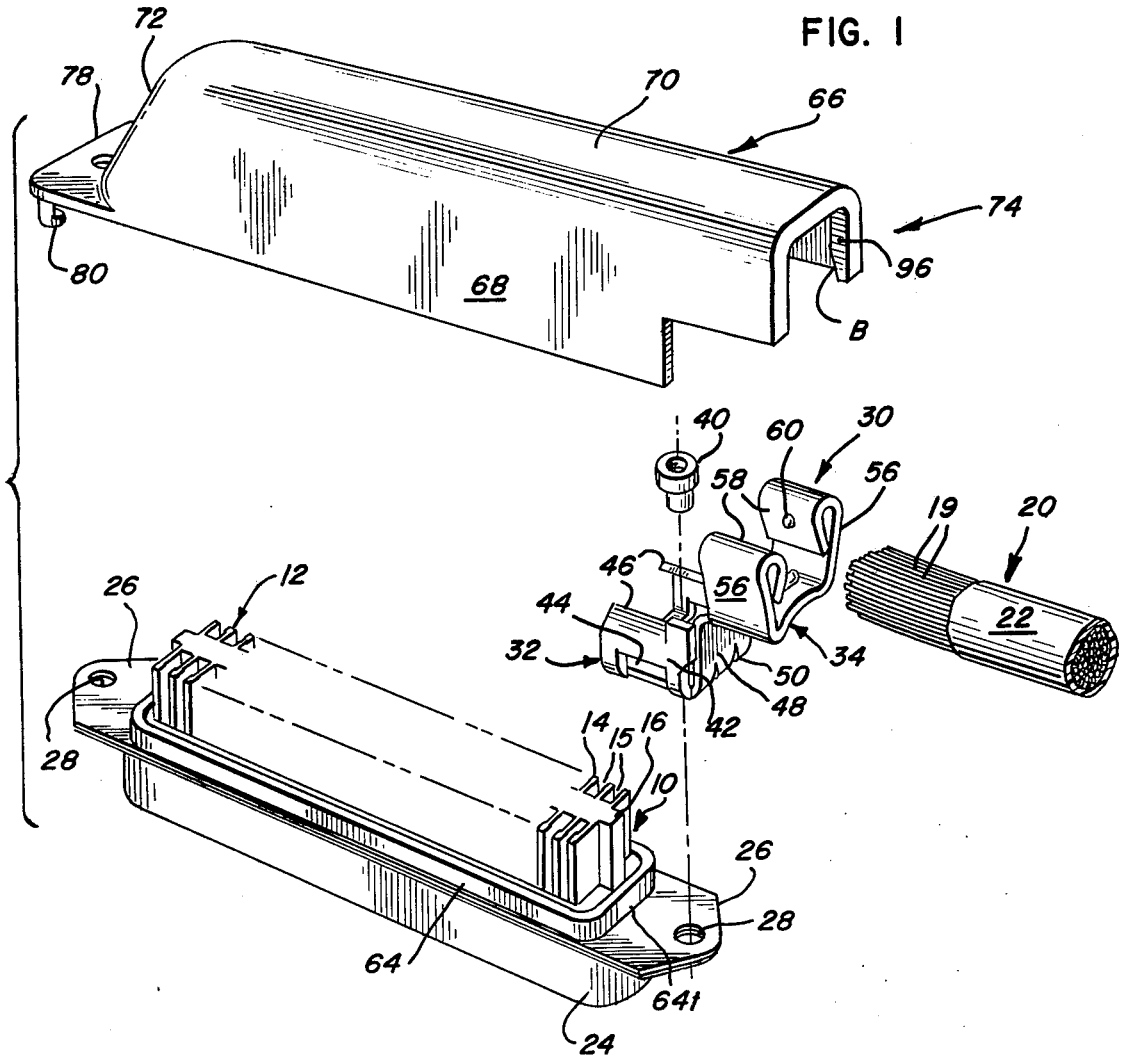
FIG. 1 is an exploded perspective view illustrating a ribbon-type connector having a metal shell, with a cable clamp adapted to be mounted on one end thereof and a hood construction in accordance with teachings of this invention, the hood being adapted to envelop the connector and clamp after they have been assembled.

Referring now more particularly to FIG. 1, a connector 10 is illustrated having an upper insulator portion 12 comprising a plurality of opposed parallel barrier portions 14 extending from a central rib 16. Disposed in the channel 15 between each pair of barrier portions 14 is a metal contact 18, see FIG. 7, adapted to engage and terminate an insulation-covered wire 19. The wires 19 typically are bundled in a cable 20 having an outer casing 22 of an insulating plastic material.

The lower portion of connector 10 is housed in metal protective shells 24 and 64 defining opposed tapered end flange portions 26 which may be apertured as at 28 for reception of a securing screw or the like. The illustrated connector 10 is of the type manufactured by TRW Inc. of Elk Grove Village, Ill. and referred to as a Cinch Ribbon Connector. Connectors of the general type illustrated are also manufactured by a number of other manufacturers and are adapted to be employed in so-called miniature termination systems, or high density systems in which a plurality of wires are terminated in close relationship to one another.

The individual wires 19 of cable 20 may be connected to individual contacts of connector 10 by soldering or by a solderless technique such as is disclosed in the McKee and Witte application Ser. No. 443,678, filed Feb. 19, 1974. The illustrated contacts 18 are of the so-called solderless type adapted to effect electrical contact with the conducting portion of a wire when the wire is urged or pressed laterally into such contacts.

After the wires 19 of cable 20 have been terminated in the contacts of a connector 10, the cable may be clamped into relatively immovable relationship with the connector by a clamp 30. Clamp 30 provides a strain relief preventing an axial pull or other force imparted to the cable 20 from imparting a force to any of the individual cable wires 19 which would result in any such wire being pulled free from a contact 18 of the connector 10 thereby breaking a wire termination therein.

Referring now also to FIGS. 3-8, the cable clamp 30 comprises a base or anchor portion 32 connected to and integrally formed with a clamp portion 34. Anchor portion 32 has a base 36 having a central aperture 38 adapted to align with aperture 28 of the connector end portion 26 so that a securing means such as rivet 40 of FIG. 1 may anchor the clamp 30 in place on the connector end 26 in the manner most clearly seen in FIG. 6.

Base portion 36 of clamp 30 is integrally formed at opposed lateral edges with opposed side walls 42 each of which is slotted at its juncture with base portion 36 at 44 as seen in FIGS. 1, 2, 4, 5, 6 and 7. The upper distal portions 46 of the side walls 42 are bent inwardly as is most clearly seen in FIG. 6 for a reason which will hereinafter be made more apparent.

End wall 48 is also integrally formed with base portion 36 of the clamp 30 and extends at substantially right angles thereto between the opposed parallel wall portions 42 in the manner illustrated in FIG. 6. Gusset-like depressions 50 are formed at the bend between the end wall 48 and base 36 for purposes of rigidifying the structure and resisting bending at the right-angle juncture.

The upper end of end wall 48 is integrally formed with clamp portion 34, see FIG. 3, of the cable clamp 30 and a diamond shaped gusset-like depression 52 is disposed at the latter juncture. Clamp portion 34 comprises a cable-supporting bottom 54 integrally formed at opposed lateral edges with side walls 56 having terminal reverse bend portions 58 which define curved surfaces on the inside of each opposed side wall 56. Upwardly projecting from the bottom 54 is an elongate projection or rib 57 which extends transversely to the longitudinal axis of the cable to be rested on bottom 54. Rib 57 may be deformed upwardly as a result of a dimpling operation. Disposed on an inwardly-facing portion of reverse bend 58 of one side wall 56 is a projecting detent 60, see FIGS. 1 and 3, and on the opposed reverse bend portion 58 are two inwardly projecting detents 60 spaced in the manner illustrated in FIG. 3 so that the single detent 60 is interposed the opposed detents 60. The relative disposition is also clearly seen in FIG. 4.

Figure 2:
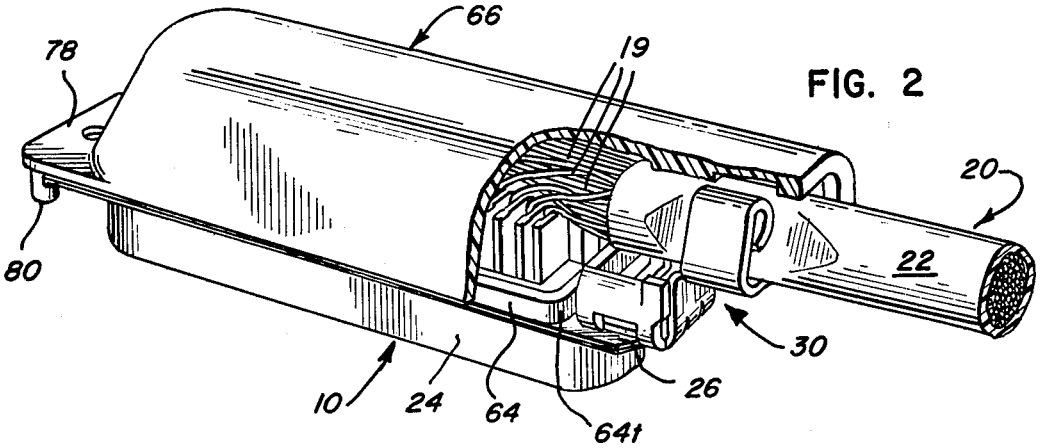
FIG. 2 is a perspective view, partly broken away, illustrating the elements of FIG. 1 in a normal position of assembly.

In the normal connector-clamp assembly, base portion 36 of clamp 30 is disposed atop one connector end flange 26 so that the clamp aperture 38 is in alignment with the aperture 28 of connector 10. The rivet 40 is then inserted and upset in the manner illustrated in FIG. 6. An equivalent securing means such as a screw may be used. It will be noted from FIG. 2 that in the normal position of assembly, the inner ends of the clamp anchor portion 32 abut against transverse edge portion 64*t* of upper metal shell 64 of the connector 10 as seen in FIGS. 1 and 2 of the drawing. Accordingly, after rivet 40 has been set in place, cable clamp 30 is prevented from rotating and is disposed in fixed immovable relationship on the connector flange portion 26.

Following termination of the individual wires 19 in their respective channels 15 of the connector 10, the cable 20 may be clamped in clamp 30 by placing the cable 20 on base portion 54 of clamp portion 34 of the connector 30. The opposed side walls 56 are then bent inwardly by a tool such as a pliers or the like, from the initial outwardly-diverging position of FIG. 1 into the position of FIGS. 2 and 6 wherein the opposed side walls 56 are slightly convergent inwardly or substantially parallel. In such a disposition the interposed cable 20 will be compressed by the enlarged reverse bend portions 58 as the projecting detents 60 dig into the resilient insulating sheath 22 of the cable 20. Detent rib 57 is simultaneously urged into ultimate contact with an engaged cable peripheral portion resting on the clamp bottom 54. Such engagements insure the absence of axial slidable movement of the cable 20 relative to clamping portion 34 of the clamp 30 upon exertion of axial forces on the cable. Thus even though the connector 10 is fixedly mounted on a chassis board or the like and forces are exerted along the cable axis, the terminations of the individual wires 19 in the contacts 18 of the connector will remain undisturbed.

Side walls 56 and reverse bend portions 58 integrally formed therewith define clamping ears which effectively clamp a cable such as cable 20 without the need for any additional securing means. The ears and remaining clamp portions integrally formed therewith are formed of a ductile or deformable low carbon steel having very low or no resiliency which permits the ears to remain in fixed clamping position after inward deformation thereof.

It will be apparent from FIG. 5, however, that after cable 20 is clamped in place on clamp 30 mounted on end 26 of the connector 10, the connections or terminations between the individual wires 19 and connector contacts remain exposed.

Hood 66, see FIG. 9, is provided for purposes of enveloping insulator portion 12 of connector 10 as well as the channels 15 formed therein and the terminated portions of the wires 19 which effect electrical contact with contacts 18 of the connector. Hood 66 comprises opposed parallel wall portions 68 seen in bottom plan view comprising FIG. 10, integrally formed with an interconnecting arcuate top or ceiling portion 70, see FIG. 8. The walls merge into a closed forward end 72, see FIG. 9, oppositely disposed to an open rear end portion 74. Extending from closed forward end 72 of head 66 is a planar tab portion 78 having spaced posts 80 projecting from the bottom surface thereof oppositely disposed to the opposed parallel wall portions 68. The spaced posts 80 are predeterminately slotted at an angle at 82 to receive the leading slanted edges of a metal flange 26 of connector 10 in the manner indicated in phantom lines in FIG. 11. FIG. 12 is a sectional view illustrating the manner whereby a leading edge of connector end portion 26 is received in one slot 82 of a post 80 of the hood 66. Also, a lower, inner, longitudinal edge portion of each side wall 68 of hood 66 is relieved at 84.

The connector insulator portion 12, see FIG. 2, of connector 10 is received in the interval between the upper portions of the opposed side walls 68 of the hood 66, while the peripheral edge of the metal shell 64 is snugly received in the recess defined by the relieved lower edge portions of those walls. The height of the relieved portions 84 is substantially equal to the height of the raised peripheral edge of the metal shell 64 to insure a desired nesting engagement.

Inwardly projecting detents 88 are integrally formed with a lower distal edge portion of each side wall 68 as illustrated in FIG. 9 to form resilient latches. These detents 88 have inwardly beveled surfaces 90 at their lower inner corners.

Assembly of hood 66 to a connector-clamp assembly such as that illustrated in FIGS. 5 and 6 is a simple operation. Following the insertion of one end portion 26 of a terminated connector 10 between the slotted posts 80 of the hood planar portion 78, with the connector insulator portion including the terminated wires nested between the side walls 68 of the hood 66, the hood is moved downwardly at its open end 74 until the detents 88 snap into the recesses 44 of the cable clamp 30 to engage the shoulder at the top of the recesses in the manner illustrated in FIG. 8. The assembly is thus a simple layout type connection at one end, and a pivoting snap latch or lock at the opposite end.

Prior to snapping into the recessess 44, the inwardly projecting detents will slidably ride over and be cammed outwardly by the upwardly and inwardly convergent edge portions 46 of the cable clamp side walls 42 also illustrated in FIG. 8. Since the inwardly projecting detents 88 are disposed adjacent the hood open end 74, the portions of the side walls 68 carrying the detents 88 may readily flex apart for this camming and snap assembly operation.

Since the clamp portion 34 of cable clamp 30 is elevated in the vertical plane relative to the anchor portion 32, in the manner more clearly seen in FIGS. 1, 2 and 4 through 7, the side walls 68 need not be of full depth where covering cable clamp portion 34. Accordingly, the side wall portions of the hood 66 may be of reduced height within the terminal portion T which is adapted to cover cable clamp portion 34. It will be noted from FIGS. 7 through 10, that an inwardly projecting collar portion 96 defines the terminal end limit of portion T of hood 66; collar portion 96 is clearly illustrated in perspective in FIG. 1. Spaced inwardly from collar 96 is a second collar 98 which is wider than collar 96 and defines an inwardly projecting band which is of precisely the same height as collar 96 as is more clearly seen in FIG. 9. Outer edge 98*o* of collar 98 and inner edge 96*i* of collar 96 define with overlying ceiling portion 70 of the hood 66 a chamber 100 adapted to snugly receive between the two edges 98*o* and 96*i*, clamp portion 34 of cable clamp 30 in the manner illustrated most clearly in FIG. 7. It will be seen from FIGS. 1, 7 and 9 that the bottom portion of collar edge 96*i* is beveled inwardly at B so as to form a lead-in guide portion for an edge of the cable clamp portion 34 as the same is slid into snug engagement between the opposed edges of the receiving chamber 100 of the hood 66.

It is apparent that to disengage the connector-clamp assembly from hood 66, the opposed detents 88 are outwardly flexed from slots 44 of the cable clamp anchor portion 32, whereafter the connectors is tilted downwardly at the clamp end and then moved axially to disengage the end portion 26 from the posts 80 of the hood. The connector end then disengages the post slots 82 and simultaneously the clamp assembly is disengaged from the hood.

The snug engagement between the clamp portion 34 and the hood edges 96*i* and 98*o* as illustrated in FIG. 7 provides a rigid clamp construction preventing any relative movement between the clamp portions 32 and 34 tending to effect bending at the juncture between wall portion 48 and base portion 54 in the vicinity of reinforcing gusset formations 52 or 50. Cable clamp portion 34 is thus confined and locked in hood chamber 100 whereby any bending forces or moments tending to bend the clamp portion 34 relative to the clamp anchor portion 32 are dissipated by the enveloping hood. The resulting clamp construction remains undisturbed in a desired state of assembly with the hood 66.

The foregoing discussion has been directed to FIGS. 1 through 11 relating to a combination of a ribbon-type connector having a metal shell, a cable clamp adapted to be mounted on an end flange portion of such metal shell and a hood construction adapted to envelop such connector and clamp combination. The following discussion, directed to FIGS. 13 through 24, relates to an assembly including an all-plastic connector.

Referring now to FIG. 13 a connector 120 is therein illustrated which is composed of an electrically insulating plastic such as a ployester material which is glass-filled for strength purposes. Typical constructions of such connectors are disclosed in my co-pending application Ser. No. 736,895 filed Oct. 29, 1976. It will be noted from FIG. 13 that the illustrated connector receptacle 120 also has a plurality of opposed barriers 122 extending from a central rib portion 124. Channels 126 defined by barriers 122 house metallic contacts 128 adapted to engage wires in electrical connection such as wires 19 of cable 20 covered by resilient plastic sheath 22. Similarly to connector 10 of FIG. 1, connector 120 of FIG. 13 is adapted to be employed in so-called miniature termination systems or high density systems, and the individual wires 19 of cable 20 may be connected to the individual contacts 128 by a solderless technique.

After the wires 19 of cable 20 have been terminated in channels 126 of connector 120, cable 20 may be clamped in relatively immovable relationship with connector end 130. The end portion 130 has upper planar portion 132 from which extend at opposed lateral edges beveled ear portions 134. An aperture 136 is substantially centrally disposed in the connector end portion. Disposed inwardly of the beveled ears 134 are planar edge portions 138, one of which is clearly seen in FIG. 13.

Cable clamp 140 is particularly adapted to be mounted on end portion 130 of connector 120 and comprises an anchor portion 142 integrally formed with a clamp portion 144. Anchor portion 142 has a central base 146, and downwardly extending inner lateral edge portions 148 and outer lateral edge portion 150. The latter are of generally C-shaped sectional configuration. In the normal position of assembly with a connector 120, the lateral edge portions 148 are clamped over opposed upper portions of the connector end surfaces 138 in the manner more clearly seen in FIGS. 18 and 20. Such clamping is effected by bending of the portions 148 after the outer lateral edge portions 150 are slidably engaged over the opposed ears 134 of the connector end 130 on which the cable clamp 140 is mounted. Inner end 152, see FIG. 13, of each connector ear 134 functions as a stop surface for the portions 148 as does an opposed shoulder 54 extending at right angles to the planar surface portion 138 of the connector end 130. Accordingly, after the cable clamp lateral edge portions 148 are clamped into gripping engagement with the opposed upper edges of the connector surfaces 138, clamp 140 is prevented from moving in either axial direction by means of the stop surfaces 138 and 154. To disengage the assembly of clamp 140 from the connector end 130 once the clamp ears 148 have been clamped in place, it is necessary to pry the edge portions 148 apart so as to permit axial withdrawal of the clamp over the opposed ears 134.

Figure 15:
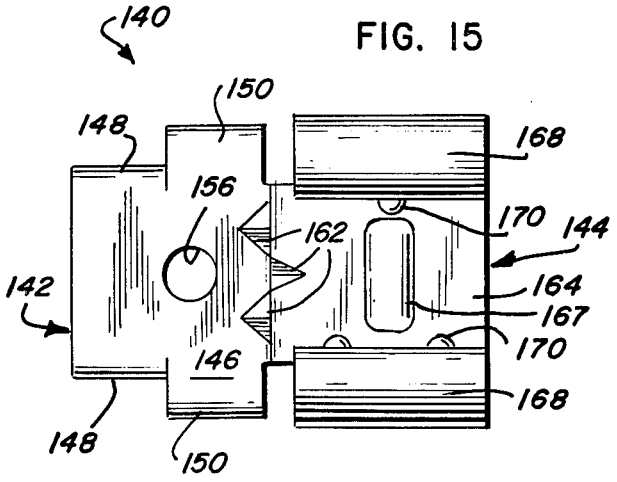
FIG. 15 is a top plan view with the cable clamp of FIG. 13 illustrated on an enlarged scale.

It will be noted from FIG. 15 that a central aperture 156 may be disposed in base 146 of clamp anchor portion 142. If it is desired that a discrete securing means such as a screw be employed for interconnecting the connector and clamp, such a securing means will permit ready disassembly of the clamp from the connector and dispense with the need of clamping the opposed lateral edge portions 148 of the clamp into engagement with the connector planar surfaces 138. Also, the discrete securing means such as a nut and bolt may add additional rigidity to the clamp connector assembly if it is desired to employ such securing means in addition to the clamping edge portions 148 of the cable clamp.

It will be seen from FIGS. 15–18 that base portion 146 of cable clamp 140 has integrally formed therewith at its outermost edge (in the normal position of assembly with connector 120), an S-shaped connecting segment 160 which also integrally joins cable supporting base 164 of clamp portion 144. The connecting segment 160 has reinforcing gussets 162 formed therein for rigidifying such connection at its integral junctures with the cable clamp base portion 142 and clamp portion 144.

Figure 16:
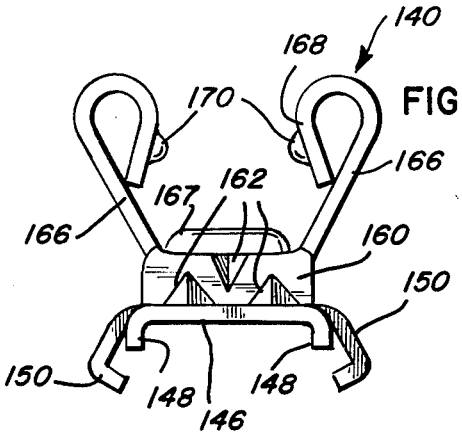
FIG. 16 is an end elevation view of the cable clamp of FIG. 15.
Figure 17:
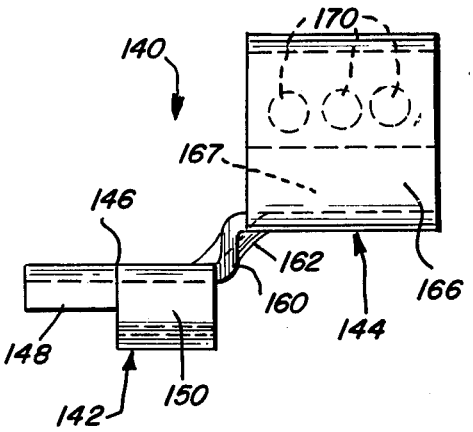
FIG. 17 is a side elevational view of the cable clamp of FIG. 15.

The base 164 of clamp portion 144 is integrally formed at opposed lateral edges with upwardly diverging clamping walls or ears 166, see FIG. 16, and has detent rib 167 similar to detent rib 57 of clamp 30 above described. Walls 166 have reverse bend terminal portions 168 on which are disposed projections 170 similar to projections 60 of clamp 30. Detent portions 167 and 170 deform and grip resilient sheath 22 of cable 20 in the manner illustrated in FIG. 10. As a result of such engagement, relative slidable movement between the cable sheath and clamp portion of clamp 140 is obviated.

As with clamp 30, no discrete securing means are necessary to secure the clamp 140 to a cable 20 for strain relief purposes. The simple clamping or bending action of the clamp ears effect a cable securement. The absence of discrete securing means such as screws, straps and the like commonly employed in the prior art enables the clamps of this invention to be utilized to great advantage in automated assembly systems. A simple closing vise or other equivalent ear-bending tool may be employed to readily secure cable 20 to either clamp 30 or 140, after which tools known in the art may readily terminate the cable wires and trim the same. If desired, the latter operations may be carried out prior to the cable-locking step.

Although clamps 30 and 140 have been described as engaging a cable periphery in which opposed walls (56, 166) are bendable toward each other, a modified arrangement may be employed which is particularly adapted for automated assembly. The modified clamps 30 and 140 in cable-receiving position would employ one clamping wall or ear is in its normal final position with the opposed wall bent away therefrom at an angle adequate to receive the cable therebetween. In the cable-engaging step only one wall is bent into a final position while the opposed wall, which may be reinforced against movement, retains its final vertical position.

Figure 19:
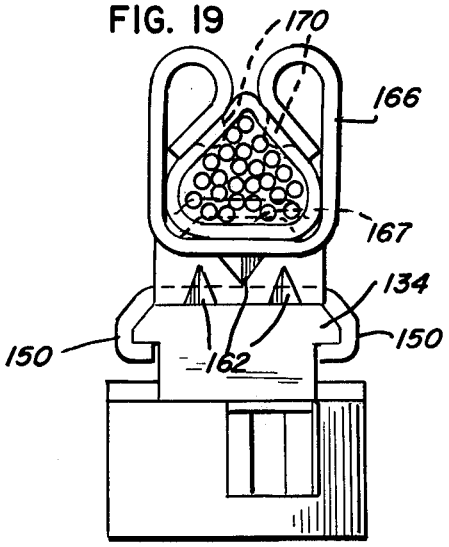
FIG. 19 is an end elevation view of the assembly of FIG. 18 illustrating a cable member in clamped engagement with the assembly.

After the wires 19 have been terminated in the contacts 128 of the connector 120 in the manner illustrated in FIG. 14, and the ears 166 of the clamp 140 have been urged into the clamping position of FIG. 19, all of the wire terminations within the connector may be visually inspected. The cable 20 is locked in immovable relationship relative to the connector 120, and any force imparted to the cable will have no effect in disturbing the wire terminations within the connector while the clamp engages the cable in the manner illustrated in FIG. 19. However, although the cable clamp 140 provides a strain relief function, it is also desired to employ a hood such as hood 170 illustrated in FIGS. 13, 14 and 20 through 23. Such hood will encompass all of the terminations effected between the wires 19 and contacts 128 disposed in the connector 120, providing a protective shield therefor.

Figure 18:
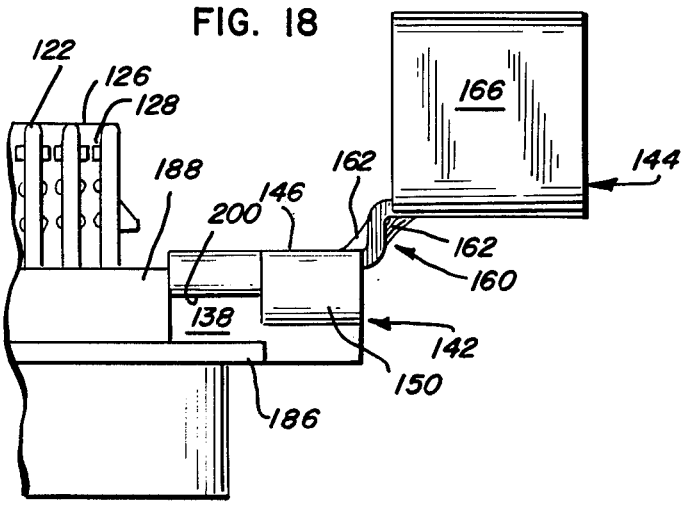
FIG. 18 is a fragmentary side elevational view of the cable clamp of FIGS. 13 through 17 mounted on an end portion of the all-plastic connector of FIG. 13.

Hood 170 is particularly adapted to mate with the connector-clamp assembly of FIG. 18 and comprises opposed parallel walls 172 having an open rear end portion 173. An opposed forward end 176 of reduced height is apertured at 178 for passage of a securing means or the like, if the same be desired for purposes of assembling the hood with an enveloped connector such as connector 120 and/or a supporting chassis. In addition to central aperture 178, end portion 176 of connector 170 has spaced coring apertures 180 formed for the molding of inwardly projecting foot portions 182 which define opposed slots 184, see FIG. 24, adapted to receive laterally projecting ears 134 of connector 120, see FIG. 13, in a slidable interlock. The interval between the innermost surfaces of the opposed parallel wall portions 172 of the hood 170 are adapted to receive upper insulator portion 121 of connector 120 disposed atop central planar connector portion 186, see FIGS. 13 and 14. Opposed longitudinal edge portions 188 of connector 120 comprising continuations of connector shoulders 154 are snugly engaged between lower inner surface portions of the hood walls 172 in the manner most clearly seen in FIG. 14.

As is seen from FIGS. 13 and 22, walls 172 of hood 170 extend for their full height until open end 173 of the connector is reached. Opposed inwardly projecting foot portions 188 define the distal ends of the wall portions 172 of full height. The latter wall portions are integrally formed with a hood section 190 of substantially U-shaped sectional configuration, definining open end 173 of the hood. Hood section 190 has opposed parallel wall portions **172*r* of reduced height which define in part a clamp-receiving chamber 174 within the hood. The outermost end of said chamber is defined by a peripheral collar 177** having lower tapered lead-in edge portions *b* formed along lower distal edge portions of the walls **172*r*. Collar 177 comprises an inwardly projecting band adapted to cooperate with spaced inwardly projecting band 179 defining the innermost edge of chamber 174 as seen in FIG. 22. Outermost edge 179*o* of band 179 and innermost edge 177*i* of collar 177 function as confining edges of chamber 174 adapted to lock clamp portion 144 in axially immovable relationship within the hood 170 in the manner seen in FIG. 20**.

The normal course of hood assembly to the connector-cable clamp assembly illustrated in FIG. 18, is an extremely simple step. Tabs **134*a* of connector 120 are first inserted in slots 184 of hood 170. The opposed end portion of the hood is then simply pivoted downwardly as view in FIGS. 20 and 21 until foot portions 188 snap beneath lower shoulder or edges 200 of the opposed clamping edge portions 148, see FIGS. 18 and 20. The partially broken away view of FIG. 21 illustrates a hood left foot portion 188 in interlocked relationship in the interval defined by lower edge 200 of clamp edge portion 148 and the underlying upper surface of connector planar portion 186**.

As a result of being snugly locked in hood chamber 174 between the opposed edge portions **178*o* and 176*i* as illustrated in FIG. 20, a force imparted to the cable 20 tending to effect movement of the cable clamp portion 144 relative to the cable clamp anchor portion 146 will be dissipated by the hood. Such force dissipation prevents bending of the cable clamp at the S-shaped connection 160, and also obviates any danger of fracturing the connector 120 in the vicinity of the connector end portion 130**.

It is seen from the foregoing that novel clamp and hood constructions have been provided which are adapted to be assembled to multi-contact connectors of varying constructions. The clamps are of simple unitary construction, and engage the cable with a simple easily automated binding action, while also forming the shoulders for attachment of the hoods. The provided hood constructions enable a strain relief cable clamp to be first mounted in fixed position on a connector end, and after all wire terminations within the connector have been visually inspected, a protective hood may then envelop all terminations within the connector. The means of attachment of the clamp to the connector is a relatively simple matter, and similarly the engagement between the hood and the connector-clamp assembly is a simple snap action requiring no discrete securing means. The hood constructions above described may be readily detached from the connector clamp assemblies by merely outwardly flexing the foot and wall portions from engagement with the receiving recesses of the clamp-connector assembly. The novel hood constructions provided prevent damaging bending action from taking place in the cable clamp constructions above described.

Although the foregoing description related to specific clamp and hood embodiments having mating structures, it is apparent that specific structural detail may vary from that illustrated. Thus, the specific shape of the clamp clamping portions may vary and yet perform as described above, and the hood constructions may vary accordingly to mate therewith as described.

The specific material of composition employed in the formation of the clamps and hoods are similarly not of critical importance. The clamp ear portions should possess the ductility properties discussed above. A suitable material of composition is AISI 1010 annealed steel in sheets or coils approximately 0.047 inch thick from which clamp blanks may be punched. A suitable plastic material of fabrication for the hood construction is manufactured by General Electric Co. under the trademark Noryl N190.

Thus it is believed apparent from the foregoing discussion that a number of modifications may be made in the various constructions illustrated which remain within the spirit of this invention. Accordingly, this invention is to be limited only by the scope of the appended claims.

What is claimed is:

1. A cable clamp for use with an electrical connector including an anchor portion adapted to be fixedly mounted on a connector, and a cable clamp portion comprising opposed clamping elements for securely engaging a cable therebetween; each of said elements being deformable toward the other to effect gripping and retention of such cable disposed therebetween, said clamping elements being substantially nonresilient and of sufficient strength to prevent movement of a clampingly engaged cable relative thereto without the need for discrete securing means.

2. A cable clamp as in claim 1 wherein said cable clamp portion comprises a base portion and a pair of opposed, spaced, generally parallel elements each integrally joined to said base portion.

3. A cable clamp as in claim 2 wherein each of said elements includes a cable gripping protuberance thereon.

4. A cable clamp as in claim 1 wherein said anchor portion and said cable clamp portion are of unitary construction, being formed of deformable metal.

5. A cable clamp as in claim 1 wherein said anchor portion comprises a substantially planar base, and includes an interconnecting portion integrally joined with said anchor portion and with said cable clamp portion.

6. A cable clamp as in claim 5 wherein a protruding rib is disposed on said planar base at substantially right angles to said clamping elements.

7. The cable clamp as in claim 1 in which said anchor portion has opposed mounting means for clampingly engaging opposed edge portions of a connector end portion in immovable relation.

8. The cable clamp as in claim 7 in which said anchor portion has opposed means adapted to snugly slidably interfit with opposed edge portions of such a connector disposed adjacent said mounting means.

9. The clamp construction of claim 1 in combination with a connector construction comprising a body of electrically insulating plastic; a plurality of wire-engaging contacts mounted on such body; each of said contacts having a wire termination portion for engaging a wire in electrical contact; said connector having opposed end portions defining opposed longitudinal ends of said connector construction; and means mounting said clamp anchor portion in immovable relation on one of said connector end portions.

10. The combination of claim 9 in combination with a hood covering said connector contact-wire termination portions and said clamp construction; said hood having opposed slotted portions at one end thereof and opposed inwardly extending detents affixed to opposed parallel hood walls; said detents being disposed at a hood end opposite said hood one end; the hood slots slidably engaging one end of said connector at said one hood end and said hood detachably interlocking with said clamp portion at the opposed hood end by means of said detents.

11. A cable clamp for use with an electrical connector including an anchor portion adapted to be fixedly mounted on a portion of such connector and a deformable cable clamp portion for engaging and retaining a cable engaged thereby; said clamp portion comprising opposed substantially clamping elements of sufficient strength to prevent movement of a clampingly engaged cable relative thereto without the need for discrete securing means; said anchor portion defining opposed locking means for engaging and retaining a connector hood on a connector on which said clamp is mounted.

12. The clamp of claim 11 in which said locking means comprise opposed locking shoulders adapted to engage opposed locking means of such a connector hood.

13. The clamp of claim 11 in which said locking means comprise opposed slots adapted to interlockingly engage opposed projecting detents of such a connector hood.

14. The clamp of claim 11 in which said anchor portion locking means also comprise clinching means adapted to clampingly engage opposed edge portions of an end portion of such connector end portion on which mounted.

15. A clamp construction for use with an electrical connector, the combination comprising a base adapted to be fixedly mounted on a connector end portion; opposed side walls extending from opposed lateral edges of said base and integrally formed therewith; an end wall portion extending at substantially right angles from said base between said side walls; said end wall being contiguous with a cable clamp portion having spaced bendable clamping ears of a ductile metal having substantially no resiliency for clampingly engaging a cable or the like therebetween without the need for additional securing means.

16. The cable clamp of claim 15 in which each of said side walls is slotted adjacent its juncture with said base portion; such slots being directly opposed to each other in parallel relation.

17. The clamp of claim 15 in which said clamping ears extend from an interposed floor portion with which said ears are integrally formed; said floor portion being disposed on a plane parallel to said base portion and at a different level in the vertical plane.

18. The clamp construction of claim 15 in which said base portion has an aperture for passage of securing means whereby said clamp may be secured to a connector end portion.

19. The clamp construction of claim 15 in which said base portion has depending clamp edge portions for clampingly engaging opposed edge portions of an interposed connector end portion.

20. The clamp construction of claim 15 in combination with a connector construction having a body portion formed of electrically insulating plastic on which a plurality of contacts are mounted; each of said contacts having a wire termination portion for engaging a wire in electrical contact and a mating portion extending oppositely to said termination portion for engaging a mating portion of a contact of another connector; said connector having end portions defining the opposed longitudinal ends of said connector; and means securing said clamp construction to one of said connector end portions.

21. The combination of claim 20 in which said connector has a metal shell encompassing said contact mating portions; opposed planar extensions of said shell comprising said connector end portions.

22. The combination of claim 20 in combination with a hood adapted to cover said connector body portion and the contact termination portions mounted thereon; said hood having opposed parallel wall portions joined by an interconnecting ceiling portion, said wall portions being joined by a hood end wall portion at one hood end and being unconnected at an opposed open hood end; a planar tab portion extending from said one hood end; said hood having opposed slotted portions at said one hood end; inwardly projecting detent portions inwardly projecting from opposed inner wall portions of said hood construction; a terminal end of said connector being slidably received in the slots of said one hood end and the detent portions of said hood being interlocking engaged with said claim side walls; said detents being disposed adjacent said hood open end whereby said supporting wall portions may be resiliently urged apart prior to said detents engaging said clamp wall slots.

23. The combination of claim 22 in which parallel, spaced, projecting stop means are disposed about the inner periphery of said hood; the interval between said stop means being adapted to snugly receive said cable clamp bendable ears therebetween.

24. A hood for an electrical connector or the like having a plurality of wire engaging contacts therein for effecting terminations with conductors, comprising a housing of a configuration to cover the terminations of such electrical connector; said housing including mounting portions for engaging such a connector for securement of said housing thereon, and a second housing portion of a configuration to receive an upstanding portion of a discrete cable clamp mounted on said connector for restricting such a clamp from moving relative to said connector, whereby forces applied to such a clamp from a cable clamped thereby are transferred to said hood from the clamp when said hood is assembled with such a connector and cable clamp.

25. The hood of claim 24 wherein said second portion of said housing includes shoulders for engaging the outer and inner ends of such a clamp for precluding significant movement thereof longitudinally of such a connector.

26. The hood of claim 24 wherein said second portion of said housing defines a pocket for receiving and engaging such an upstanding portion of a cable clamp as said hood is assembled with such a connector and cable clamp.

27. A hood for use with an electrical connector or the like in assembly with a discrete cable clamp mounted on said connector; said hood comprising means for interlockingly engaging such assembly whereby said hood may effect a further assembly therewith; said hood also having a chamber configured to snugly receive a portion of the clamp extending from the connector whereby movement of the clamp relative to the connector is prevented while disposed in said hood chamber.

28. The hood of claim 27 in which said interlocking means are adapted to effect interlocking engagmeent with both a connector and clamp when in a state of assembly.

29. A hood for an electrical connector or the like comprising an open-bottom enclosure adapted to house a portion of a connector therein; said enclosure comprising opposed generally parallel side walls; means joining said side walls and maintaining the same in spaced generally parallel relation; slot-defining means extending from portions of said side walls defining one end of said hood; second ends of said parallel walls oppositely disposed to said hood one end defining an open second end having inwardly projecting detent means disposed on the lower inner edge portions thereof; and inwardly projecting portions on spaced inner peripheral portions of said parallel walls defining a receiving chamber therebetween for engaging a cable clamp in said chamber.

30. The hood of claim 29 in which end portions of said parallel walls defining said hood open second end are of reduced height whereby terminal edge portions of said end portions of reduced height defining the hood open bottom are disposed in spaced relation with the edges of the remainder of said parallel walls of full height which define the hood open bottom; said projecting detent means being disposed on the inner surface portions of said parallel walls of full height adjacent said open end.

31. The hood of claim 30 in which said inwardly projecting surface portions disposed on spaced inner peripheral portions of said hood are disposed substantially adjacent the ends of said parallel walls of reduced height as measured along the longitudinal axis of said hood construction.

32. The hood of claim 30 in which distal edge portions of said parallel walls of full height are uniformly relieved on the inner surfaces thereof from said hood one end to said projecting detent means.

33. The hood of claim 29 in which each of said detent means has a beveled outer surface adapted to facilitate spreading apart of said hood parallel walls of full width.

34. In combination, an electrical connector including a body containing terminals for terminating a plurality of wires of a cable; a cable clamp for mounting on said body and including a projecting portion for engaging and securing a cable of such wires to be terminated for strain relief purposes; and a connector hood separate from said connector and said clamp engageable with said body and for covering said terminals; said hood including a portion of a configuration to engage said projecting portion of said cable clamp for restricting said clamp from moving relative to said connector when said hood is assembled with said body and said cable clamp.

35. The combination of claim 34 in which said cable clamp has opposed shoulders disposed on spaced wall portions of said clamp disposed parallel to the connector longitudinal axis, and said hood has projecting detents inwardly projecting from parallel hood wall portions interlockingly engaging said shoulders.

36. In a clamp construction for use with a ribbon connector, the combination comprising a clamp anchor portion adapted to be mounted on the end of a ribbon connector; said anchor portion comprising a base having a first opposed pair of laterally disposed bendable clamping edge portions adapted to clampingly engage a connector edge portion therebetween; second opposed lateral edge portions disposed adjacent said first edge portions and defining channel-like recesses; and a cable clamp portion integrally formed with said anchor portion and having bendable clamping means extending along axes substantially parallel to said first and second edge portions; said clamping means being substantially nonresilient and of sufficient strength to prevent movement of a clampingly engaged cable relative thereto without the need for discrete securing means.

37. The clamp construction of claim 38 in combination with a connector construction having a body portion formed of electrically insulating plastic on which a plurality of wire-terminating contacts are mounted; said connector body portion having laterally projecting and longitudinally extending edge portions; each of said contacts having a wire termination portion for engaging a wire in electrical contact; said connector having opposed projecting portions integrally formed with said body portion defining opposed longitudinal end portions of said connector; each end portion having opposed planar side edge portions and opposed laterally projecting portions adjacent said planar portions; said planar side portions being disposed inwardly of said laterally projecting portions; said clamp second opposed lateral edge portions slidably receiving said connector projecting end portions in said channel like recesses thereof in a slidable engagement; said clamp first clamping edge portions being clampingly engageable with said connector planar side edges after said slidable engagement in the normal clamp-connector assembly; terminal edges of said first clamping edge portions extending longitudinally of said connector being spaced from said laterally projecting connector body edge portions extending longitudinally of said connector so as to define gaps therewith.

38. The combination of claim 37 in further combination with a hood adapted to cover said contact terminating portions and said clamp construction; said hood having opposed parallel wall portions joined together at one hood end and defining an open hood end at the opposite hood end; the interior of said closed hood end having opposed channels adapted to slidably receive the connector laterally projecting portions of one connector end; the open end of said hood having inwardly projecting detents formed on opposed portions of said parallel walls adapted to flex relative to the hood longitudinal axis; said projecting detents being interlockingly received beneath portions of said first opposed clamping edge portions of said clamps when mounted on said connector.

39. The combination of claim 38 wherein said hood has a chamber formed therein to snugly receive a distal portion of said cable clamp portion bendable clamping means when said hood is interlocked with said connector, whereby exerted forces tending to move said clamp relative to said connector are reacted to by said hood.

40. In combination, an electrical connector including a body containing terminals for terminating wires; said body having end portions on opposite ends thereof; a cable clamp adapted for mounting on said body and including a projecting portion for engaging and securing a cable of such wires to be transmitted for strain relief purposes, and a connector hood engageable with said body and suitable for covering said terminals; said hood including a portion of a configuration to engage said projecting portion of said cable clamp for restricting said clamp from moving relative to said connector when said hood is assembled with said body and said cable clamp; said cable clamp having opposed clamping portions clinched to opposed edges of the connector end portion on which mounted and said hood having projecting detents inwardly projecting from parallel wall portions effecting an interlocking engagement with distal edges of said opposed clamping portions.

41. The combination of claim 34 wherein said connector is a ribbon-type connector and said body portion has opposite end portions, said cable clamp being mounted on one of said end portions and said hood engaging said body and said projecting portions of said cable clamp.

42. The combination of claim 41 wherein said hood has sliding engagement with the end portion of said body opposite from the end portion on which said clamp is mounted.

43. The combination of claim 42 wherein said hood and said cable clamp include cooperable detent means for detachably interlocking said hood to said cable clamp.

44. The combination of claim 20 in which said connector end portions are formed of electrically insulating plastic integral with said body.

45. The combination of claim 34 in which said clamp projecting portion includes deformable, opposed substantially nonresilient clamping elements of sufficient strength to prevent movement of a clampingly engaged cable relative thereto without the need for discrete securing means.

46. In a hood adapted for use with an electrical connector or the like having a discrete cable clamp mounted thereon with a cable secured thereto; the improvement comprising a clamp-receiving chamber disposed in said hood; said hood having spaced inwardly projecting means which define in part said clamp-receiving chamber; said projecting means cooperating with said clamp to prevent relative axial movement between said clamp and said hood when said clamp is disposed in said hood chamber, whereby said clamp is restrained from moving relative to said connector on which mounted when disposed in said chamber.

47. The clamp of claim 11 in which said clamp portion has a cable-supporting bottom from which said opposed clamping elements extend; said clamping elements having reverse bend portions and being bendable toward each other so as to compress an interposed cable supported on said bottom against said bottom.

* * * * *

UNITED STATES PATENT AND TRADEMARK OFFICE

CERTIFICATE OF CORRECTION

PATENT NO. : 4,127,315

DATED : November 28, 1978

INVENTOR(S) : WILLIAM H. McKEE

It is certified that error appears in the above-identified patent and that said Letters Patent are hereby corrected as shown below:

Column 7, line 35, change "connectors" to -- connector --

Column 12, claim 11, line 33, after "substantially" insert -- nonresilient --

Column 15, claim 37, line 27, change "38" to -- 36 --

Column 16, claim 40, line 24, after "parallel" insert -- hood --

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*